United States Patent [19]

Arteaga

[11] Patent Number: 4,800,945

[45] Date of Patent: Jan. 31, 1989

[54] STRIP-ARTICULATED DOOR THAT TURNS IN SMALL RADIUS

[76] Inventor: Alfredo G. Arteaga, Serrano 2240, Floor 1, Dept. 9, Buenos Aires, Argentina, C.1425

[21] Appl. No.: 23,048

[22] Filed: Mar. 6, 1987

[51] Int. Cl.[4] ..... E05B 15/06

[52] U.S. Cl. ..... 160/196.1; 16/106; 104/93; 104/109; 49/411

[58] Field of Search ..... 160/196 R, 196 D, 201; 16/106, 102, 89; 49/410, 411; 104/106, 107, 109, 118, 89, 93, 242, 243, 245, 247

[56] References Cited

U.S. PATENT DOCUMENTS

| | | | |
|---|---|---|---|
| 442,273 | 12/1890 | Payson, Jr. | 16/106 |
| 1,426,170 | 8/1922 | Frantz | 160/196 X |
| 4,646,652 | 3/1987 | Barleson | 160/201 X |

FOREIGN PATENT DOCUMENTS

| | | | |
|---|---|---|---|
| 573691 | 4/1933 | Fed. Rep. of Germany | 160/196 |
| 153131 | 6/1932 | Switzerland | 160/196 |
| 270933 | 9/1950 | Switzerland | 160/196 |

*Primary Examiner*—Ramon S. Britts
*Assistant Examiner*—Blair M. Johnson
*Attorney, Agent, or Firm*—Richard C. Litman

[57] ABSTRACT

An improved sliding door composed of articulated strips in which the novel features are a high guide containing a rotating vertical wheel that supports two adjacent strips and a rotating horizontal wheel that follow a curved track. Additional features include a floor guide that contains only straight segments that are not joined together the corner and a base guide attached to the articulated strips that travels within the floor guide without touching said floor guide during stationary or ordinary operation of the door.

9 Claims, 4 Drawing Sheets

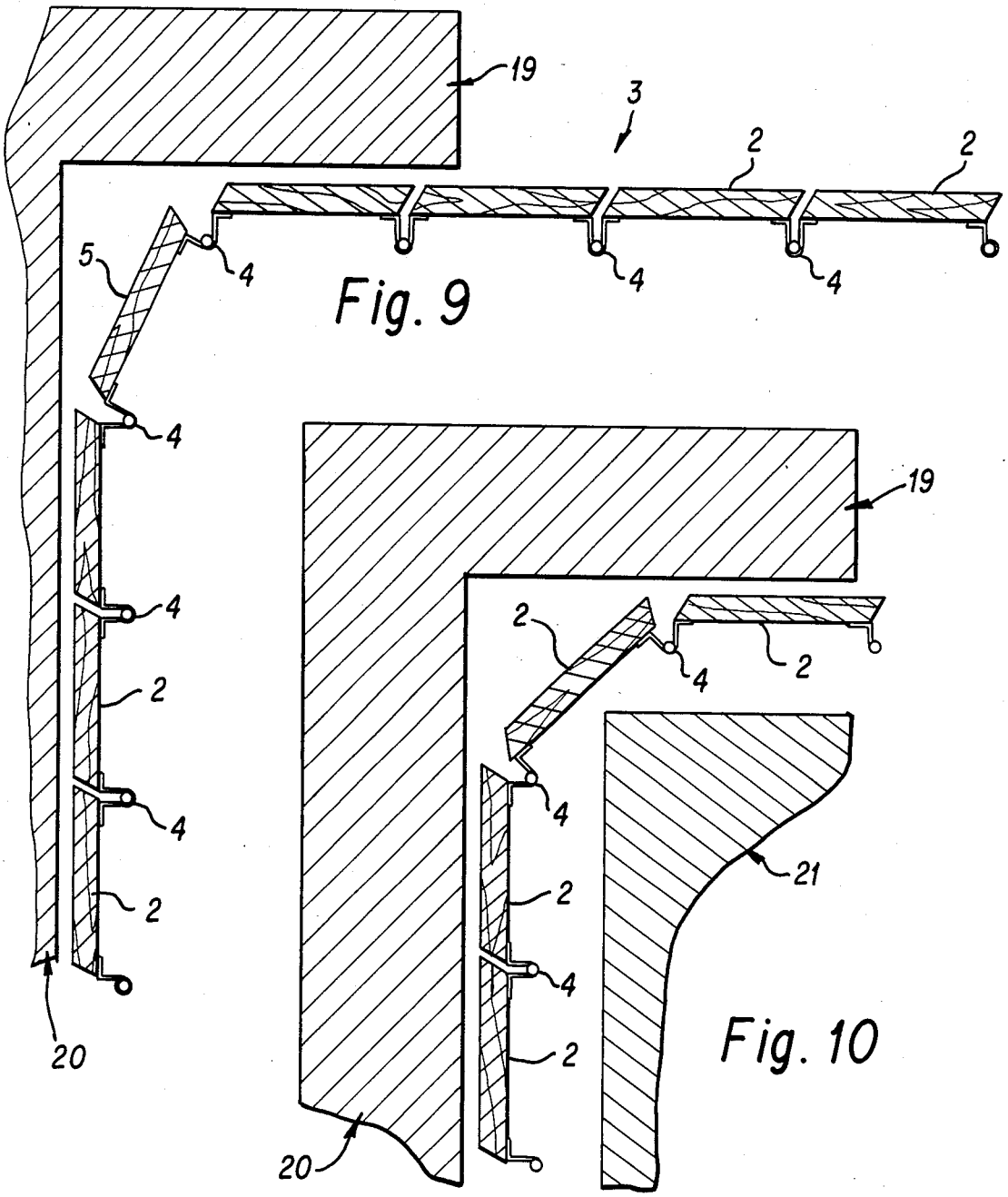
Fig. 9
Fig. 10
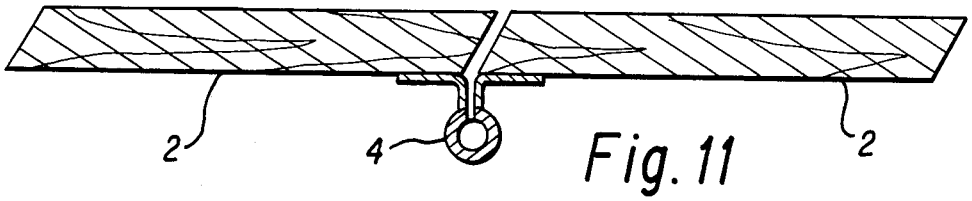
Fig. 11

STRIP-ARTICULATED DOOR THAT TURNS IN SMALL RADIUS

BACKGROUND OF INVENTION

1. Field of Invention

There are three kinds of sliding doors: folding, sliding planes (outside or into the wall), and sliding parallel strips. The invention corresponds to the last situation when used near two walls at an angle. All the articulated doors presently in use are hanging on vertically rolling wheels connected by axial rods, to the articulated strips, but technically this is a poor design that doesn't operate well. In all these articulated doors, the flanges of the wheel slides on the high guide and the curved part of the high guide must turn the door. The inside surface of the wheel which touches the curved part of the guide, in fact, pushes the guide; in curves with small radius, the wheel tries to climb the guide, causing a braking effect against the sliding door. To overcome this effect, the strength needed to operate the door must increase, resulting in damage to all door parts as well as the guide. The damaged door needs more and more power to slide, and after a short time, becomes useless.

2. Description of the Prior Art

Patents relating to the field of the present invention are as follows:

U.S. Pat. No. 1,099,399: R. Schneider, Jr.

U.S. Pat. No. 1,896,748; J. M. Kirkpatrick.

U.S. Pat. No. 2,116,847; E. K. Pilcher

The Schneider patent shows a sliding door hanger having vertical roller wheels, but is preferred embodiment is for a flat portion of a freight car; no provision is made for the turning of a corner by the door. The Kirkpatrick patent shows the construction of a door, gate, or partition hung from a moving guide that slides on a track made from two straight sections at right angles connected by a diagonal third straight section causing oblique changes in direction of travel of the guide. This constuction has some similarity to that of the present invention, but its hanging guide comprises only vertical wheels, which is a construction not well suited for traveling around a sharp corner. The Pilcher patent shows a flexible screen with sections secured together by hinged joints each of which comprises a rod and semitubular member interlocking in such a way that adjacent sections may bend smoothly at the joint allowing the screen to travel on a curved track. This construction, however, is entirely different from that of the present invention.

SUMMARY OF THE INVENTION

Application of the invention resolves all problems of the doors in turning around a sharp corner. The doors are not braked when turning because there are two wheels over the high guide. Each articulated strip hangs from a vertical wheel while the horizontal wheel rotates smoothly in the curved track, preventing the bracking effect. Friction in minimized in the configuration of the invention because all components of the frictional forces have been reduced to rolling frictional forces.

Another advantage of the invention resides in the design of the floor guide, which is open at the corner between the front wall and side wall to further reduce friction as the door travels past the corner by eliminating contact between the door and the floor guide entirely. The preferred design of the base guide may be replaced by any number of equivalent designs as long as the lower part of the door can travel within the floor guide without touching it except for deflections due to lateral contact tending to keep the door centered within the guide.

The novel doors of the invention differ in design from the prior art in detailed features they require to operate easily. They are suitable for installation in small and large areas. Because they need little space, they save the volume of the room for other purposes.

BRIEF DESCRIPTION OF THE DRAWINGS

FIG. 9 is a cross section showing the articulated strips when turning.

FIG. 10 is the same section as in FIG. 9, but also showing an object 21 around which the door can turn and remain stored betweem the object and the wall.

FIG. 11 shows a cross section of two strips and their articulation.

DESCRIPTION OF THE PREFERRED EMBODIMENT

Figure 1:
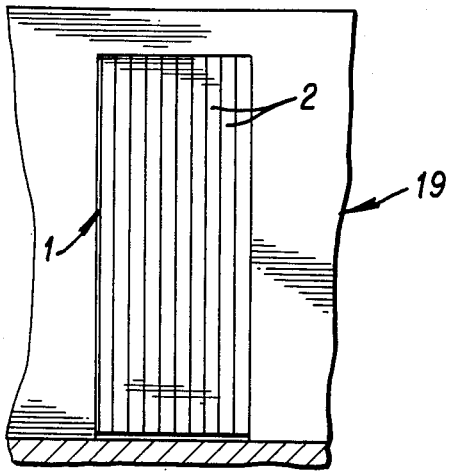
FIG. 1 is a frontal view of the closed door.
Figure 2:
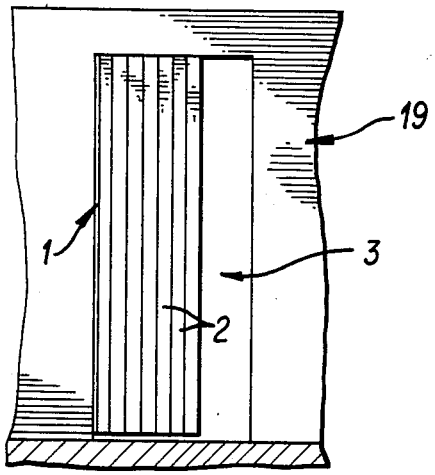
FIG. 2 is a frontal view of the partially open door.
Figure 4:
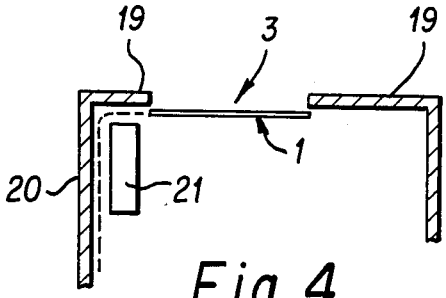
FIG. 4 is a plan view of the closed door.
Figure 3:
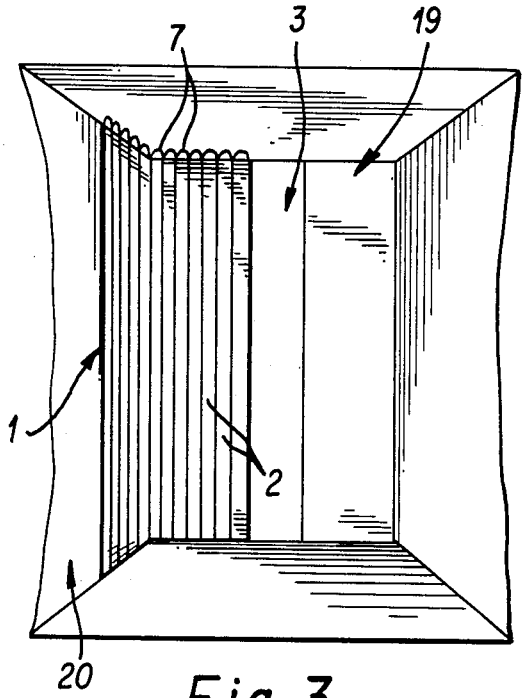
FIG. 3 is an inside perspective of the partially open door.
Figure 5:
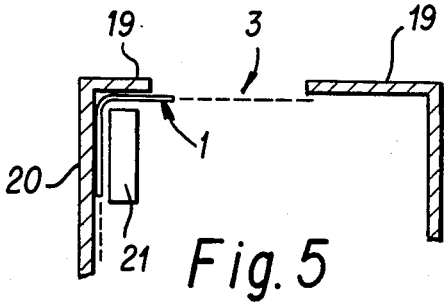
FIG. 5 is a plan view when the door is partially open.
Figure 6:
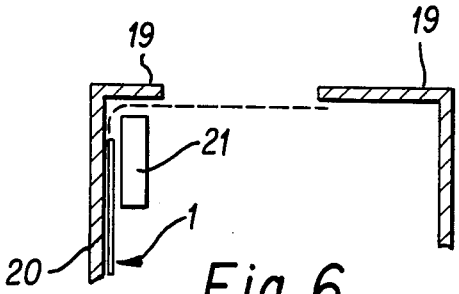
FIG. 6 is a plan view of the completely open door.
Figure 7:
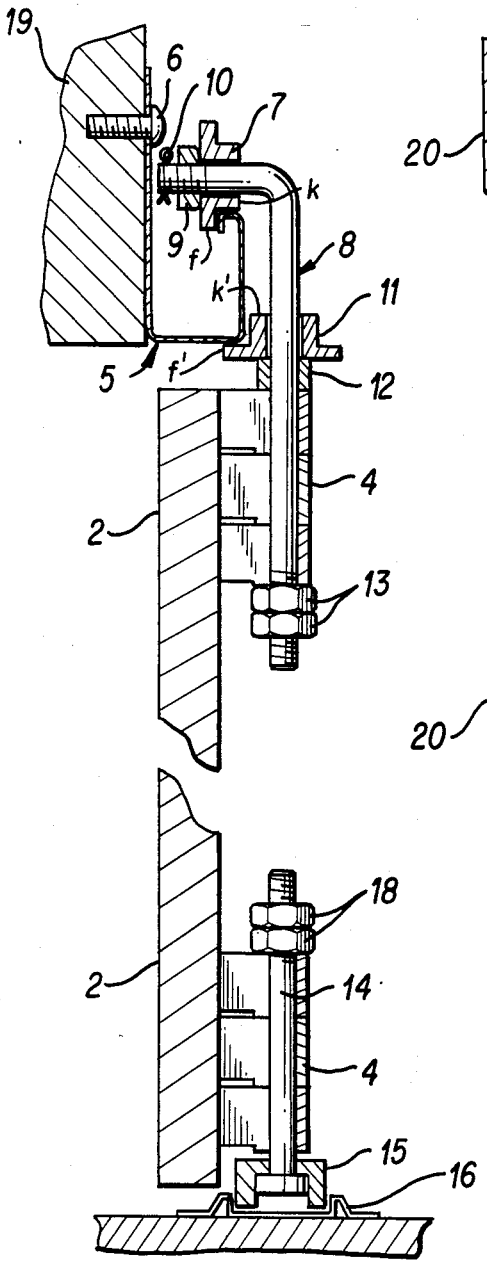
FIG. 7 is a vertical cross section showing the details of the parts of the door and its corresponding guides.
Figure 14:
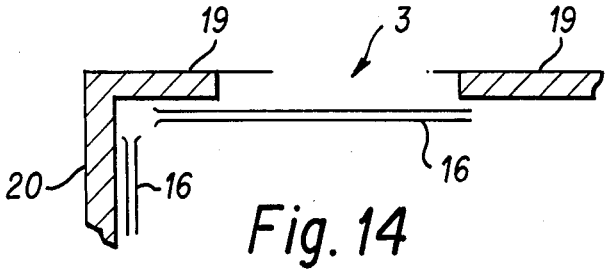
FIG. 14 shows the floor guide extended entirely past the doorway and along a sidewall.
Figure 15:
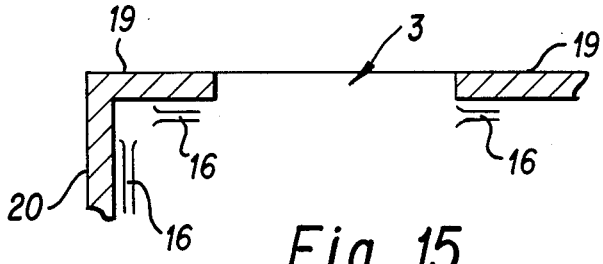
FIG. 15 shows an alternative floor guide separated into two pieces along the front wall.
Figure 8:
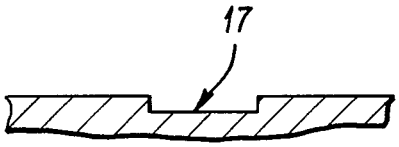
FIG. 8 shows a cross section of the floor guide.
Figure 12:
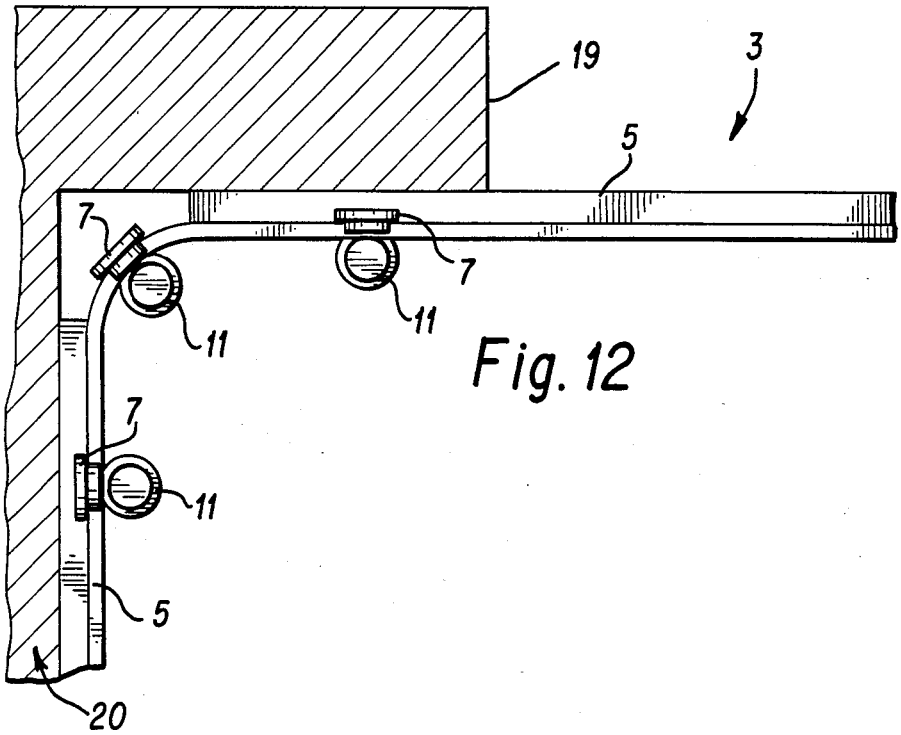
FIG. 12 shows a plan detail of the high guide with wheels 7 and 11. Each wheel supports an articulated strip. The wheels 11 rotate along the design curve without braking the door as it moves.
Figure 13:
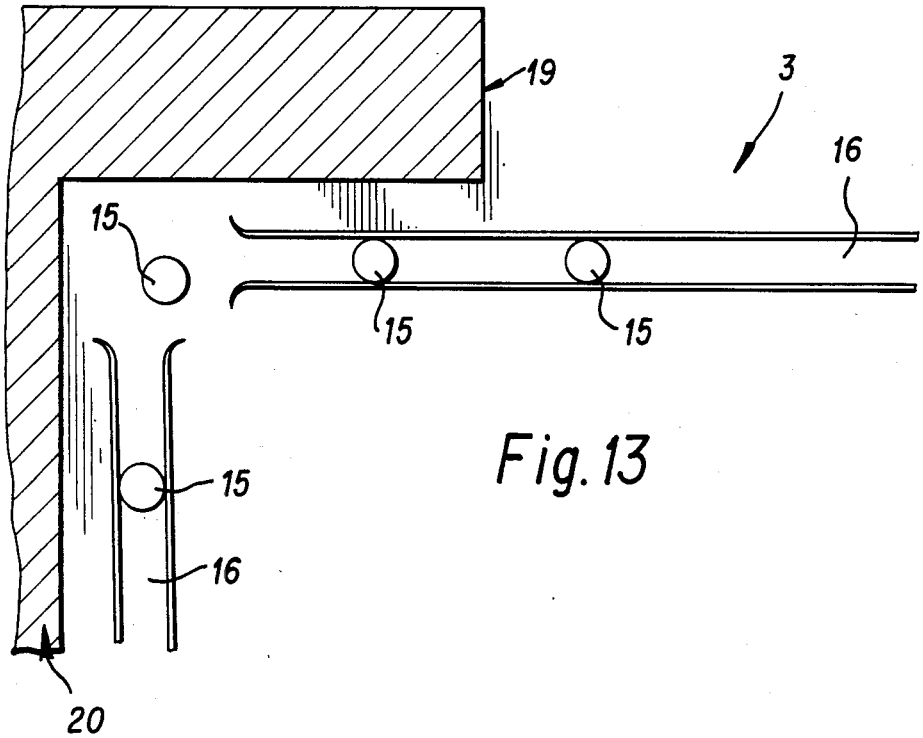
FIG. 13 shows a plan detail of the floor guide.

The present invention pertains to a two-roller guide assembly for a strip-articulated sliding door that allows said door to turn in a small radius of curvature about a corner on a high guide track as primarily shown in FIG. 7. In between each pair of articulated strips 2 of the door 1 is the two-roller guide assembly. Each vertical wheel or roller 7 rotates about the horizontally disposed section of an inverted L bent axial rod 8, as it travels along the head section of high guide track 5. Vertical roller 7 consists of a flange f which prevents derailment and hub h which contacts the head of high guide track 5 and supports the weight of the sliding door. Said track 5 may bend around a corner and extend past the doorway 3. For this case, a novel feature of the invention is the introduction of horizontal roller that rotates about the vertically disposed section of inverted L-bent axial rod 8 and significatnly reduces frictional forces that would impede travel of the sliding door about the corners. around to rods 8 that permit travel around Horizontal roller 11 also consists of a flange f which contacts the base section of high guide track 5 and hub h which contacts the web section of said guide track. A suitable means for holding the vertical and horizontal roller in position is shown in FIG. 7. A washer nut spacer 9 and cotter pin 10 which passes diametrically through a bore located at the extremity of the horizontally disposed section of inverted L-bent axial rod 8 serve to hold the wheel 7 in position; a threaded sleeve hinge 4 coaxial with the vertically disposed section of L-bent axial rod 8 and fastened by two positioning nuts 13 similarily acts to position wheel 11. Said sleeve hinges 4 are fixed solidly to two adjacent strips at the pivotal positoin. Bolts 6 serve to solidly attach guide 5 to the wall 19. A floor guide, either of grooved 17 or tracked 16 type, allows the base structure, composed of straight vertical rod 14, sleeve 4, and cylindrical block 15, to travel parallel to the high guide. Positioning nuts 18 threading over sleeved hinge 4 fasten rod 14 to the bottom of strip 2; cylindrical block 15 which is free to rotate about the vertical axis of rod 14, is held in place by fitting between sleeve hinge 4 above and the protruded head of rod 14 below. The sides of block 15 ordinarily do not touch the floor guide, although spurious motions of the strip bottom will be corrected by deflection of block 15 from the guide surfaces. Some minor variations of the configuration are also shown in the drawings. FIGS. 4, 5, 6, and 10 show how an object 21 may be located close to the door without interfering with operation of the door. FIGS. 14 and 15 show that said floor guide may either be a single structure or be composed of two pieces, one on either side of said doorway 3. The overall design of the invention minimizes the space that it requires for operation and eliminates any damaging frictional forces that may impede travel of the door. Operation of the door guide invention is shown in FIGS. 1–6. The door 1 when closed is shown in FIGS. 1 and 4; when partially open, in FIGS. 2 and 5; and when completely open, in FIGS. 3 and 6. In these figures, wall 19 is cut out to form doorway 3, and the door 1 slides between side wall 20 and an inanimate object 21.

The present invention may be embodied in other specific forms without departing from the spirit or essential attributes thereof, and, accordingly, reference should be made to the appended claims, rather than the foregoing specification, as indicating the scope of the invention.

What is claimed is:

1. A two-roller guide assembly for a strip-articulated sliding door that allows said door to turn in a small radius of curvature about a corner on a high guide track comprising:

a vertical roller that rotates about the horizontally disposed section of an inverted L-bent axial rod consisting of a flange which prevents derailment from said high guide track and a hub which contacts the head of said high guide track and adapted to support the weight of the sliding door, a horizontal roller that rotates about the vertically disposed section of said inverted L-bent axial rod consisting of a flange which contacts the base section of said high guide track and a hub which contacts the web of said high guide track and adapted to reduce frictional forces that would impede travel of the sliding door about said corner;

said sliding door consisting of a plurality of articulated strips, each pair of adjacent strips at the upper pivotal position is interiorly secured to the vertically disposed section of said inverted L-bent axial rod by fastening means;

means for holding said vertical and horizontal rollers in position and means for securing the high guide track to the interior surface of a walled enclosure.

2. A two-roller guide assembly according to claim 1 wherein:

said vertical roller is held in position by a washer nut spacer and a cotter pin arrangement in which said pin passes diametrically through a bore located at the extremity of the horizontally disposed section of said inverted L-bent axial rod.

3. A two-roller guide assembly according to claim 1 wherein:

said horizontal roller is held in position by a spacer and threaded sleeve hinge arrangement coaxial with the vertically disposed section of said inverted L-bent axial rod and fastened by positioning nuts.

4. A two-roller guide assembly according to claim 3 wherein:

said threaded sleeve hinge is solidly affixed to a pair of said adjacent strips.

5. A two-roller guide assembly according to claim 1 wherein:

said high guide track is secured to the interior surface of said walled enclosure by bolts.

6. A two-roller guide assembly according to claim 1 including:

a base structure interiorly secured between each pair of said articulated strips at the lower pivotal position consisting of a vertical rod having a protruded head at its lower end, a threaded sleeve hinge coaxial with said rod and a cylindrical block fitted between said sleeve hinge and the head of the vertical rod adapted to freely rotate about the vertical axis of said rod and fastened together by positioning nuts at the upper end of the vertical rod; and a floor guide assembly adapted to receive said cylindrical block.

7. A two-roller guide assembly according to claim 6 wherein:

said threaded sleeve hinge is solidly affixed to a pair of said adjacent strips.

8. A two-roller guide assembly according to claim 6 wherein:

said floor guide assembly is open at a corner between a front wall and a side wall, eliminating contact with said cylindrical block.

9. A two-roller guide assembly according to claim 8, wherein:

said floor guide assembly includes a cross sectional configuration comprising an open top groove.

* * * * *